US005483887A

United States Patent [19]

Grosshauser

[11] Patent Number: 5,483,887

[45] Date of Patent: Jan. 16, 1996

[54] PAPER GUIDE FOR WEB-FED PRESS

[75] Inventor: Heinrich K. Grosshauser, Würzburg, Germany

[73] Assignee: Koenig & Bauer Aktiengesellschaft, Wurzburg, Germany

[21] Appl. No.: 395,154

[22] Filed: Feb. 27, 1995

Related U.S. Application Data

[63] Continuation of Ser. No. 112,467, Aug. 27, 1993, abandoned.

[30] Foreign Application Priority Data

Aug. 28, 1992 [DE] Germany ..... 42 28 610.7

[51] Int. Cl.[6] ..... B41F 5/18

[52] U.S. Cl. ..... 101/181; 101/180; 101/221; 101/424.1

[58] Field of Search ..... 101/179, 180, 101/181, 182, 219, 220, 221, 222, 416.1, 417, 418, 424.1

[56] References Cited

U.S. PATENT DOCUMENTS

| | | | |
|---|---|---|---|
| 971,534 | 10/1910 | Firm | 101/222 |
| 1,738,324 | 12/1929 | Scott | 101/222 |
| 2,076,932 | 4/1937 | Barber | 101/179 |
| 2,112,586 | 4/1937 | Barber | 101/179 |
| 2,435,791 | 2/1948 | Luehrs . | |
| 4,412,490 | 11/1983 | Grosshauser | 101/180 |
| 4,480,543 | 11/1984 | Hechler | 101/181 |
| 4,831,926 | 5/1989 | Bowman et al. | 101/181 |
| 5,179,899 | 1/1993 | Burger et al. | 101/221 |

FOREIGN PATENT DOCUMENTS

| | | | |
|---|---|---|---|
| 806874 | 12/1936 | France . | |
| 2122060 | 8/1972 | France . | |
| 353593 | 4/1987 | Germany . | |
| 0137968 | 10/1981 | Japan | 101/222 |

*Primary Examiner*—Edgar S. Burr
*Assistant Examiner*—Lynn D. Hendrickson
*Attorney, Agent, or Firm*—Jones, Tullar & Cooper

[57] ABSTRACT

A paper guide for a web-fed rotary printing press which prints multiple colors on both sides of a paper web uses multiple color printing groups arranged in pairs on a plurality of vertically spaced levels. Separate air drying paths are provided for the web after it has been initially printed in multiple colors on one side and again after it has been printed in multiple colors on its other side. The length of these paths are a multiple of the spacing between plate cylinders in each of the levels of the printing machine.

6 Claims, 1 Drawing Sheet

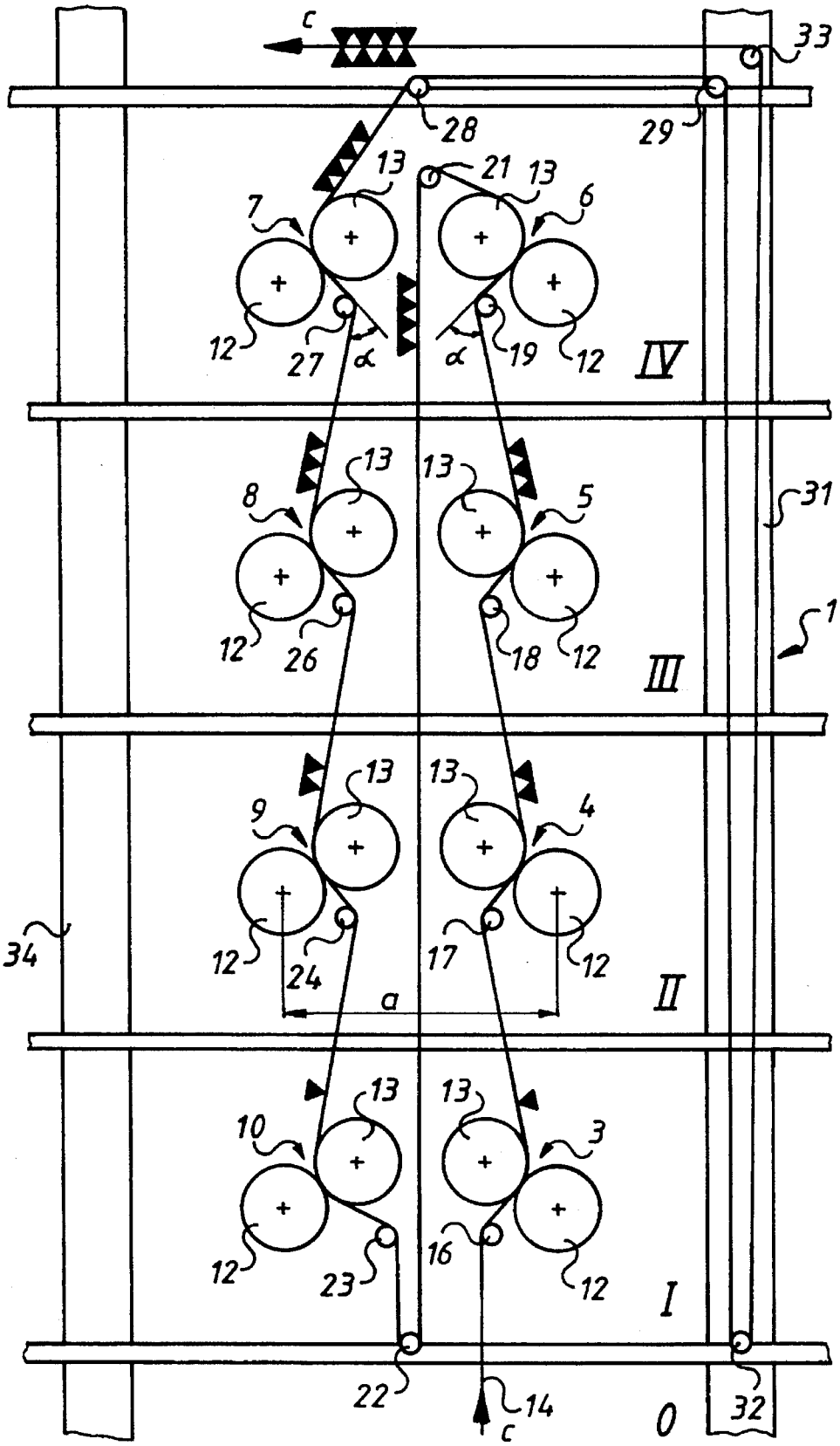
c
33
28
29
13
21
13
7
6
12
27
α
α
19
12
IV
13
13
8
5
31
12
26
18
12
III
1
13
13
9
4
34
12
24
17
12
a
II
13
13
10
3
12
23
16
12
I
22
14
c
0
32

PAPER GUIDE FOR WEB-FED PRESS

This application is a continuation, of application Ser. No. 08/112,467, filed Aug. 27, 1993 now abandoned.

FIELD OF THE INVENTION

The present invention is directed generally to a paper guide for a web-fed printing press. More particularly, the present invention is directed to a paper guide for a web-fed rotary printing press. Most specifically, the present invention is directed to a paper guide for a web-fed multiple color rotary printing press. The paper web guide is usable to provide paper web air drying travel paths having sufficient lengths so that a web of coated paper, which has been printed on both sides in pluralities of colors, will be dry before each of the multiple color printed sides of the web are brought into contact with possible ink smearing surfaces, such as guide rollers. The lengths of the paper web air drying travel paths are a function of the number of colors being printed on each side of the web and the size of the printing cylinders.

DESCRIPTION OF THE PRIOR ART

It is generally known in the art to use flexographic inks, which are water based inks, in the printing of newspapers and the like in web-fed rotary printing presses. The German Patent Disclosure DE 35 35 993 A1 is one example of a prior teaching of the use of these kinds of water based inks In the prior art these water based inks were typically used to print on uncoated or natural paper. Such paper is relatively absorbent so that black inks as well as various other colors of inks could be used in printing multi-colored products such as newspapers without the need rot a lengthy ink drying path or procedure. In the printing of these uncoated or natural papers using water based inks, it was not necessary to utilize other than the generally conventional air-drying process to suitably dry the inks prior to the printed web being further handled or manipulated without fear of the ink being smeared.

In an effort to attain a higher image quality, the trend has been to the use of so-called "coated paper" which lends more color brilliance to the printed product, such as a multi-colored daily newspaper. This means that the drying process must be improved or accelerated to avoid smearing of the fresh ink on the coated paper. There is little space available in present printing machines for the addition of large drying systems. The effective result is that the production speed of the printing press, which may print in multiple colors on both sides of a web, must be reduced to a speed such that the multiple colored printed coated paper will have adequate time to dry before either web side comes into contact with a possibly ink smearing device, such as a turning bar, a guide roller, or the like.

It will thus be seen that a need exists for a paper web guide which provides sufficient drying time for drying both sides of multiple colored printing webs of coated or uncoated paper. The paper guide for a web-fed press in accordance with the present invention provides such a device and is a significant advance in the art.

SUMMARY OF THE INVENTION

It is an object of the present invention to provide a paper guide for a web-fed press.

Another object of the present invention is to provide a paper guide for a web-fed rotary printing press.

A further object of the present invention is to provide a paper web guide for a web-fed multiple color printing press.

Still another object of the present invention is to provide a paper guide for a web fed press which uses a plurality of water based inks.

Yet a further object of the present invention is to provide a paper web guide for a web fed press that prints in multiple colors using water based inks on both sides of a coated web.

Even still another object of the present invention is to provide a paper web guide for a web fed printing press in which the distance of travel of the freshly printed web is a function of the size of the printing cylinders and the number of colors being printed.

As will be discussed in detail in the description of the preferred embodiment which is set forth subsequently, the paper guide for web-fed printing presses in accordance with the present invention utilizes groups of printing couples on four vertically spaced levels of a printing apparatus. A first printing couple in the lower level prints one side of a paper web in black ink. The partially printed web then is guided up through the next three successive levels, where it is printed on one side by as many as three printing couples in three additional colors. After the fourth or final color has been applied to a first side of the web, it is guided from the upper portion of the upper level to the lower portion of the lower level without the first multiple color printed image being contacted by any guide rollers or the like. The distance which the multiple color printed web travels before it contacts a guide roller or turning bar on its freshly printed first surface is determined by multiplying the spacing distance between the axes of rotation of the two plate cylinders in the printing groups in each level by the number of different colors being used in the printing of the web. An additional distance of web travel can be utilized if it is important that the multiple color printed web be completely free of even the smallest smears or color distortions.

The paper web, which has been printed on one or a first side in a plurality of colors as it has passed upwardly through the four levels of the printing machine, and which has had its first printed side air-dried as it has been directed along a first air drying path down to the lower portion of the lowest level and has been fed around a first guide roller or turning bar which contacts the printed first side, is now printed in up to four colors on its second side by again passing up through the four levels of the printing machine. As the web emerges from the top of the printing machine for the second time, it is then directed along a second air drying path across the top of the machine and again down to the bottom of the printing machine. At this point, the second, freshly printed side of the web contacts a second printed side contacting guide roller or turning bar. The distance of web travel in this second air drying path is also a function of the number of colors printed on the second side of the web and the spacing between adjacent plate cylinders in each of the pairs of printing couples on each of the printing levels.

By providing paper web guide or air drying paths whose lengths are a function of the spacing of the plate cylinders and the number of different colors being printed, it will be possible to air-dry both sides of the freshly printed web in a sequential manner, even when the substrate being printed is the so-called "coated paper". There is no need to provide additional drying devices such as forced air ventilators or heaters. Since the guide rollers do not immediately come into contact with the freshly printed, multiple-color web, a smear-free, brilliant color printing on the coated paper is attained. The paper guide assembly of the present invention provides sufficiently long paths of travel for the printed web so that both sides of the web will dry completely. This allows the production speed of the printing press to be increased so that it corresponds with a press speed that would be used with uncoated paper. Either coated or uncoated paper can be printed without the need for changing inks in accordance with the type of paper being used. A brilliant 4/4 color printing on coated paper can be attained.

The paper guide for web-fed multiple color printing presses in accordance with the present invention overcomes the limitations of the prior art devices. It provides a substantial advance in the art.

BRIEF DESCRIPTION OF THE DRAWINGS

While the novel features of the paper guide for web-fed printing presses in accordance with the present invention are set forth with particularity in the appended claims, a full and complete understanding of the invention may be had by referring to the detailed description of the preferred embodiment which is set forth subsequently, and as illustrated in the sole drawing figure which is a schematic side elevation view of a web-fed rotary printing press in accordance with the present invention.

DESCRIPTION OF THE PREFERRED EMBODIMENT

Referring to the sole drawing figure, there may be seen a preferred embodiment of a paper guide for a web-fed press. A web-fed rotary printing machine, which is usable to print a multiplicity of different colors of ink onto a web of coated or uncoated paper is shown generally at 1 in the drawing. A total of eight printing groups, 3–10, are disposed in the printing machine. Printing groups 3 and 10 occupy a first, lowest level I; printing groups 4 and 9 occupy a second, lower intermediate level II; printing groups 5 and 8 occupy a third, upper intermediate level III; and printing groups 6 and 7 occupy a fourth, upper level IV. Each of these printing groups, which are arranged in pairs 3 and 10; 4 and 9; 5 and 8; and 6 and 7 on the four levels of the printing machine and which each have a spacing "a" between the plate cylinders in each pair, is supported between spaced side frames of the printing machine 1, in a generally well known manner. The printing groups themselves are also generally conventional in operation. Each printing group 3–10 includes a plate cylinder 12 which carries at least one generally soft, flexible letter press printing plate, which is not specifically shown in the sole drawing figure, A counterpressure cylinder 13, that is constructed of a hard metal, cooperates with the plate cylinder 12 in each of the printing groups 3–10. Each plate cylinder 12 further cooperates with a suitable screen roller that is not specifically shown and which receives printing ink from a chambered doctor blade and transfers this ink to the plate cylinder 120 Since these screen rollers, and chambered doctor blades are generally conventional and form no part of the present invention, they are not shown in the drawings.

A paper web 14 which is to be printed on both sides in multiple colors as it passes through the printing groups 3–10 in the printing machine 1, is fed in the direction indicated by arrow C from a suitable reel star or reel stand, not shown, that is located at a sub-level 0. This sub-level 0 may be the substructure of a web-fed rotary printing press. The paper web 14 enters the right side printing group 3 in the first, lowest level I after passing around a guide roller 16. This lowest right side printing group 3 prints a first side of the web 14 is a first color, such as black. The paper web 14 now passes up the right or first side of the printing machine 1 and through the printing groups 4, 5 and 6 on the right or first side of the printing machine in the second, third and fourth levels II, III and IV. Each of these printing groups 4, 5 and 6 is preceded by a guide roller 17, 18 or 19, respectively. These four infeed guide rollers 16, 17, 18 and 19 guide the paper web 14 during its upward travel through the four levels of the first side of the printing machine 1 in a manner such that the web 14 first contacts the counterpressure cylinder 13 of each of the printing groups 3–6. An angle of wrap or wrap angle α of the paper web 14 about each of the web infeed guide rollers 16–19 is in the range of 30° to 70° and is preferably 60°. A sufficient spacing is maintained between the four levels of printing groups in the machine I so that the different inks applied by the individual printing groups 3 through 6 are already pro-dried when the web 14 exits the fourth printing group 6 on the right or first side of the upper or fourth level IV of the printing machine 1.

The paper web 14, which has now been printed on a first side with four different color inks, is now directed to a guide roller 21 which is located generally in the center of the upper level IV, between the first and second side printing groups 6 and 7, as may be seen by referring to the sole drawing figure. The printed side of the web 14 on which the four colors of inks are already pre-dried, does not come into contact with the guide roller 21. The paper web 14 is now guided along a first air drying path that extends down from the middle or upper portion of uppermost level IV to the bottom portion of the lowest or first level I. At this point, the paper web 14 is passed around a first printed side contacting guide roller 22. This guide roller 22 may also be provided as a turning bar. As will be discussed in detail shortly, the length of this first air drying path is selected to be sufficiently long that the first side of the printed web 14, which has been printed in up to four colors by passing up through the four first side printing groups 3, 4, 5 and 6, will be dry before it contacts the first printed web side engaging guide roller or turning bar 22.

Now the partially printed web 14 will be printed in up to four colors on its second side to provide a 4/4 brilliantly printed web. This is accomplished by directing the web 14 from the first printed side engaging roller 22 to an infeed roller 23 for the lowest level printing group 10 on the left or second side of the printing machine 1. This printing group 10 may be provided with black ink. The paper web 14 leaves the lowest level, second side printing group 10 and passes up through the second side printing groups 9, B and 7 located on the second, third and fourth levels of the printing machine 1. As the web 14 passes up through each of these printing groups, it is printed in another color. Each of these second side printing groups 10, 9, 8 and 7 is preceded by an infeed guide roller 23, 24, 26 and 27 which insures that the web 14 engages the counterpressure cylinder 13 before it is engaged by the plate cylinder 12. A wrap angle α of the paper web 14 about each of these infeed guide roller 23, 24, 26 and 27 is in the range of 30° to 70° with an angle of 60° being preferred.

After the inks applied to the second side of the web 14 by the second side printing groups 10, 9, 8 and 7 have been pre-dried as the web 14 has passed upwardly through the second side printing groups, the web 14, which has now been printed in as many as four colors on each side, is directed generally upwardly to a guide roller 28 which is located at the upper midpoint of the uppermost, fourth level IV of the printing machine 1. This upper guide roller 28 is located above guide roller 21 and does not engage the freshly printed second side of the web 14. It guides the web horizontally across the top of the upper level of the machine 1 to a guide roller 29 which is located at an upper end of a first vertical support column 31 of the printing machine 1. The web 14, which has been freshly printed on its second side by the second side printing groups 10, 9, 8 and 7, extends down along the support column in a second air drying path to, a second printed side contacting guide roller 32 which may also be a second turning bar. This is the first point at which the printed second side of the web 14 is contacted by a guide roller or turning bar. The paper web 14 wraps around the second printed side guide roller 32 at a wrap angle of about 180° and then travels back up the support column 31 from the bottom of the lowest level I to the top of the uppermost level IV where it is redirected by a guide roller 33 back horizontally across the upper portion of the upper level IV, in the direction indicated by the arrow C. The now completely printed and dried paper web 14 can be fed to a suitable folder or the like. After having left the last of the second side printing groups 7, the paper web 14 has traveled along the second air drying path a distance of all four levels of the printing machine for effecting air drying of the web 14.

All of the various guide rollers which are secured to the printing machine are securely attached to the machine's housing. They have surfaces which are made of a water repelling material, such as a plastic, for example TEFLON. The printing machine 1 which includes the various printing groups, rollers and the like can be used in concert with other similar printing machines with pairs of these machines being situated next to, or above each other.

As indicated previously, each of the first and second printed side contacting guide rollers 22 and 32 could be embodied as paper-reversing devices, such as web-turning bare which could be ventilated.

The lengths of the first and second paper web air drying paths are determined as a function of the number of colors of ink being printed on the paper web 14 and the spacing distance "a" between the axes of rotation of the plate cylinders 12 in the path of printing groups on each of the four printing levels of the printing machine 1. Assuming that the first side of the paper web 14 is printed with a number n of printing inks as the web passes up through the first side printing groups 3, 4, 5 and 6, the minimum length of the first air drying path of the web 14 after it exits the last first side printing group 6 and before it contacts the first printed side guide roller 22 is provided as (n+1) times "a". The size of the printing machine, the vertical spacing of the printing groups in the four printing levels, and the distance "a" between the axes of the plate cylinders 12 in each pair of printing groups on each of the four levels is selected to provide a first air drying path distance which will result is this minimum length. An increase in the length to (n+2) or (n+3) times the distance "a" will insure that the ink is completely dry before the first printed side of the paper web 14 engages the first printed side contacting guide roller 22.

Assuming now that the second side of the web 14 is printed in a number of m printing inks in the second side printing groups 10, 9, 8 and 7 of the printing machine 1, the minimum distance of the second side air-drying path; i.e. the distance between the exit from the last second side printing group 7 and the second side printed paper web engaging guide roller or turning bar 32 is determined in accordance with the formula (m+2) times "a". It is also possible to select this second air-drying path for the second printed side of the paper web 14 as (m+3) times "a" particularly when an absolute guarantee of smear-free printing is required. If the number of different colors of ink "m" being applied to the second side of the paper web 14 by the second side printing groups is only two, the length of the second side air-drying path could be reduced to four times the distance "a" between the plate cylinders if the formula (m+2) times "a" is utilized. The distance "a" between the axes of rotation of the two plate cylinders 12 in each of the pairs of printing groups in the four printing levels may be generally 1.15 meters.

While a preferred embodiment of a paper guide assembly for a web-fed multiple color printing press in accordance with the present invention has been set forth fully and completely hereinabove, it will be apparent to one of skill in the art that a number of changes in, for example, the overall size of the printing machine, the supports and drives for the printing groups, the supports for the guide rollers and the like could be made without departing from the true spirit and scope of the present invention which is accordingly to be limited only by the following claims.

I claim:

1. A paper guide assembly for a web-fed printing press, said paper guide assembly comprising:

a plurality of printing groups positioned in pairs of printing groups in each of multiple levels of a printing machine, each of said printing groups having a plate cylinder and a cooperating counterpressure cylinder, said plate cylinders in each of said pairs of printing groups in each of said multiple levels being spaced a distance "a" from each other, said plurality of printing groups being arranged into first web side printing groups and second web side printing groups;

means for passing a selectably coated or uncoated web to be printed on a first side through said first web side printing groups to print said first side of said web in "n" colors using water-based inks;

a first printed web side air-drying path intermediate said first web side printing groups and said second web side printing groups, said first web side air-drying path receiving said web printed on said first web side from a last one of said first web side printing groups, said first printed web side air-drying path having a first length of at least (n+1) times said distance "a" to thereby permit complete air drying of said first side of said selectably coated or uncoated web;

means for passing said web to be printed through said second web side printing groups, subsequent to passage of said web through said first printed web side air-drying path, to print a second side of said web in "m" colors using water based inks; and a second printed web side air-drying path subsequent to said second side printing groups, said second web side air-drying path receiving said web printed on said second web side from a last one of said second web side printing groups, said second printed web side air-drying path having a second length of at least (m+2) times said distance "a" to thereby permit complete air-drying of said second side of said selectably coated or uncoated web.

2. The paper guide assembly of claim 1 further including a paper web infeed guide roller positioned before, in the direction of web travel, each of said printing groups at a wrap angle of 30° to 70°.

3. The paper guide assembly of claim 1 further including a plurality of paper web guide rollers in said printing machine, said paper web guide rollers having ink repelling surfaces.

4. The paper guide assembly of claim 3 wherein said surfaces of said guide rollers are plastic.

5. The paper guide assembly of claim 1 wherein said pairs of printing groups are arranged in vertical levels in said printing machine.

6. The paper guide assembly of claim 1 wherein said first web side air drying path extends from a last first side printing group to a first printed web side engaging guide roller and further wherein said second web side air drying path extends from a last second side printing group to a second printed web side engaging guide roller.

* * * * *